US006412743B1

(12) United States Patent
Fell

(10) Patent No.: US 6,412,743 B1
(45) Date of Patent: Jul. 2, 2002

(54) SIGNAGE SUPPORT BASE

(76) Inventor: Michael J. Fell, 541 Ramblewood Dr., Bryn Mawr, PA (US) 19010

( * ) Notice: Subject to any disclaimer, the term of this patent is extended or adjusted under 35 U.S.C. 154(b) by 0 days.

(21) Appl. No.: 09/459,758

(22) Filed: Dec. 13, 1999

(51) Int. Cl.[7] ..... A47B 19/00

(52) U.S. Cl. ..... 248/441.1; 248/346.03; 40/124.05; 40/606

(58) Field of Search ..... 248/441.1, 451, 248/460, 188.1, 910, 346.01, 450, 444, 346.03, 346.04; 40/120, 124.05, 124.06, 606

(56) References Cited

U.S. PATENT DOCUMENTS

| | | | | | |
|---|---|---|---|---|---|
| 1,152,461 | A | * | 9/1915 | Wright | 248/523 X |
| 1,829,360 | A | * | 10/1931 | Lambert | 248/523 X |
| 3,237,330 | A | * | 3/1966 | Dinstbir | 40/129 |
| 3,984,931 | A | | 10/1976 | Belokin, Jr. | 40/130 |
| 4,075,775 | A | | 2/1978 | Shorette | 40/553 |
| 4,125,243 | A | * | 11/1978 | Liptak | 248/473 |
| 4,136,474 | A | | 1/1979 | Belokin, Jr. | 40/559 |
| 4,229,913 | A | | 10/1980 | Corrigan | 52/38 |
| 4,290,218 | A | | 9/1981 | Drueck, Jr. | 40/553 |
| 4,528,764 | A | | 7/1985 | Cobb | 40/553 |
| 4,564,165 | A | | 1/1986 | Grant et al. | 248/343 |
| 4,658,526 | A | * | 4/1987 | Glasener | 40/602 |
| 4,716,671 | A | | 1/1988 | Gross | 40/558 |
| 4,856,216 | A | | 8/1989 | Gross | 40/559 |
| 4,947,570 | A | | 8/1990 | May et al. | 40/553 |
| 5,088,680 | A | * | 2/1992 | Farmer | 248/523 |
| D330,473 | S | * | 10/1992 | Lemire | D6/466 |
| 5,208,585 | A | * | 5/1993 | Sprague | 340/908.1 |
| 5,282,331 | A | | 2/1994 | Fell | 40/617 |
| 5,390,437 | A | * | 2/1995 | Pearson | 40/661 |
| 5,405,019 | A | * | 4/1995 | Cross | 211/42 |
| 5,537,767 | A | * | 7/1996 | Schneider et al. | 40/606 |
| 5,855,351 | A | * | 1/1999 | Cziraky et al. | 248/45 |
| 5,878,518 | A | * | 3/1999 | Grewe | 40/606 |

OTHER PUBLICATIONS

Dinaco Sales Flyer entitled Point–Of–Sale Inventory Items, Permanent Sign Systems.

* cited by examiner

*Primary Examiner*—Leslie A. Braun
*Assistant Examiner*—A. Joseph Wujciak
(74) *Attorney, Agent, or Firm*—Volpe and Koenig, P.C.

(57) ABSTRACT

A base for supporting variable signage comprising a support surface with front and back planar surfaces extending therefrom. Opposed side surfaces extend between the front and back planar surfaces. Each planar surface includes at least two opposed channels adapted to receive and support a changeable signage against the planar surface. At least one signage support receptacle is formed integral with the base.

16 Claims, 15 Drawing Sheets

SIGNAGE SUPPORT BASE

BACKGROUND

The present invention relates to a display sign base. More particularly, it relates to a sign base designed to accommodate changeable messages in multiple support and signage configurations.

Various types of signage systems are known in the art. These signage systems range from signs permanently attached to support structures permanently fixed at a display location, for example, street signs; to signs permanently attached to moveable support structures, for example, real estate signs; to moveable supports with interchangeable signs. The supports can include embedded posts, spiked rods that penetrate the ground, and various portable bases. The portable bases include metal or plastic tube frames, hollow structures capable of being filled with sand or water for stability, and various other configurations.

A problem common to most prior portable bases is that the bases are generally designed to accommodated only a single support and signage configuration. Additionally, many of the prior portable bases are designed with a low profile to occupy a minimum space. As a result, the bases are out of view and often pose a tripping hazard to pedestrians passing by the signs. Other bases are provided with a higher profile, however, the higher profile often results in a less stable base susceptible to wind and the like.

Accordingly, there is a need for a portable sign base which provides a stable support for multiple signage and support configurations.

SUMMARY

The present invention relates to a base for supporting variable signage. The base includes a support surface with front and back planar surfaces extending therefrom. Opposed side surfaces, preferably having a trapezoidal profile, extend between the front and back planar surfaces. Each planar surface includes at least two opposed channels adapted to receive and support a changeable signage against the planar surface. At least one signage support receptacle is formed integral with the base. The signage support receptacles are preferably configured to support various sign supports including rods, polls, square tubing and the like.

BRIEF DESCRIPTION OF THE DRAWINGS

The present invention will be described with reference to the accompanying drawings in which.

DETAILED DESCRIPTION OF THE PREFERRED EMBODIMENTS

Figure 1:
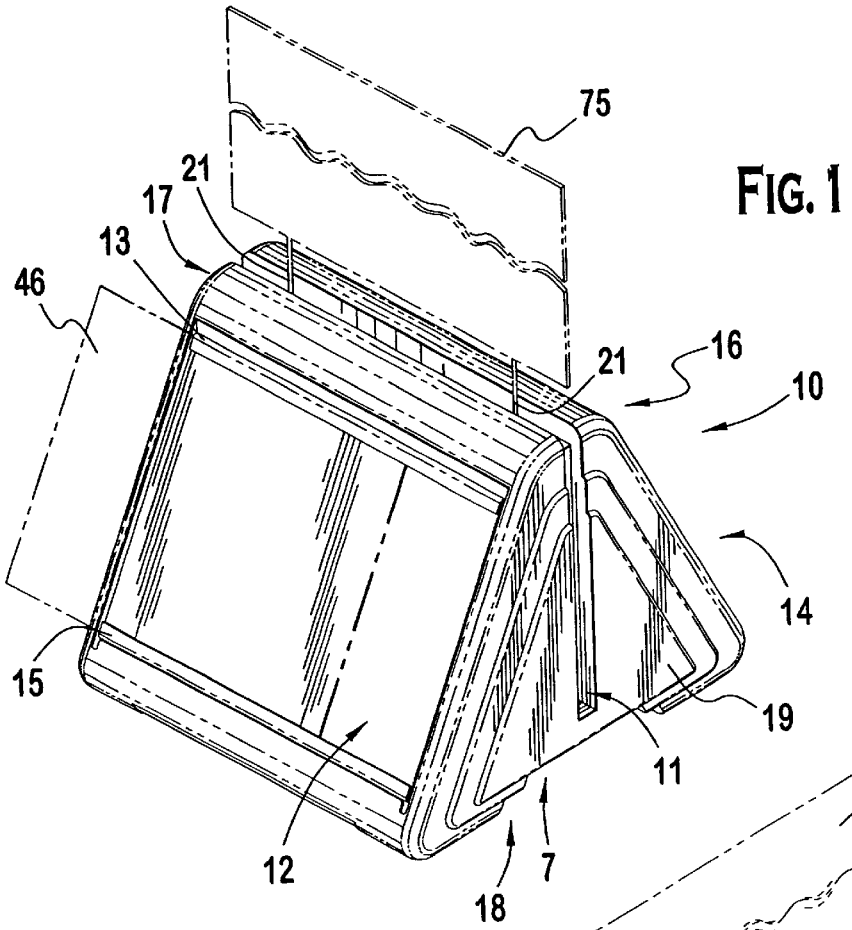
FIG. 1 is a top perspective view of a sign base in accordance with the preferred embodiment of the present invention.

The preferred embodiments of the invention will be best understood with reference to the drawings, wherein like elements are designated by like numerals throughout.

FIGS. 1 through 14 illustrate the basic structure of the preferred embodiment of the sign base 10 of the present invention. The sign base 10 preferably includes a front surface 12, a rear surface 14, an upper surface 16, a lower surface 18 and side surfaces 17 and 19 defining a single triangular unit having a hollow interior chamber 35.

Figure 2:
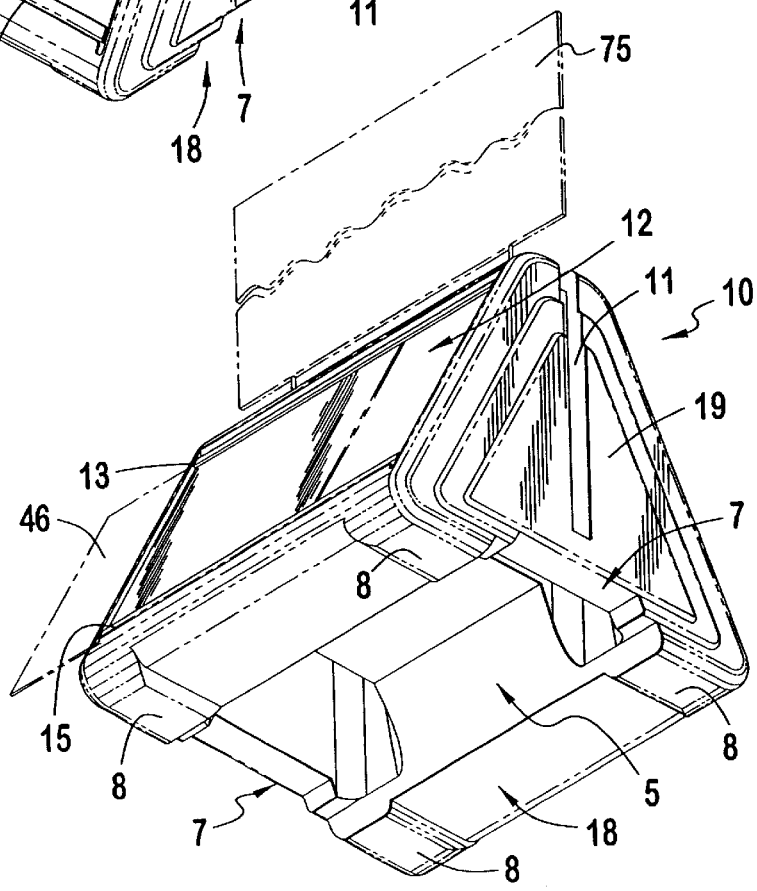
FIG. 2 is a bottom perspective view of the sign base of FIG. 1.
Figure 3:
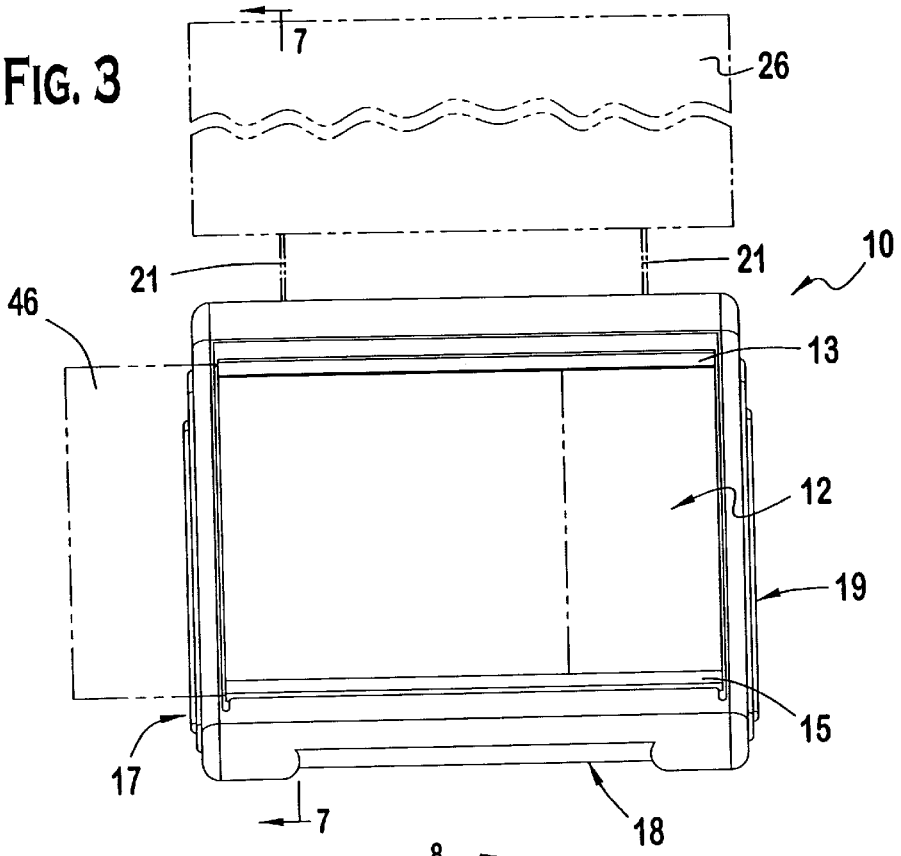
FIG. 3 is a front elevation of the sign base of FIG. 1.
Figure 6:
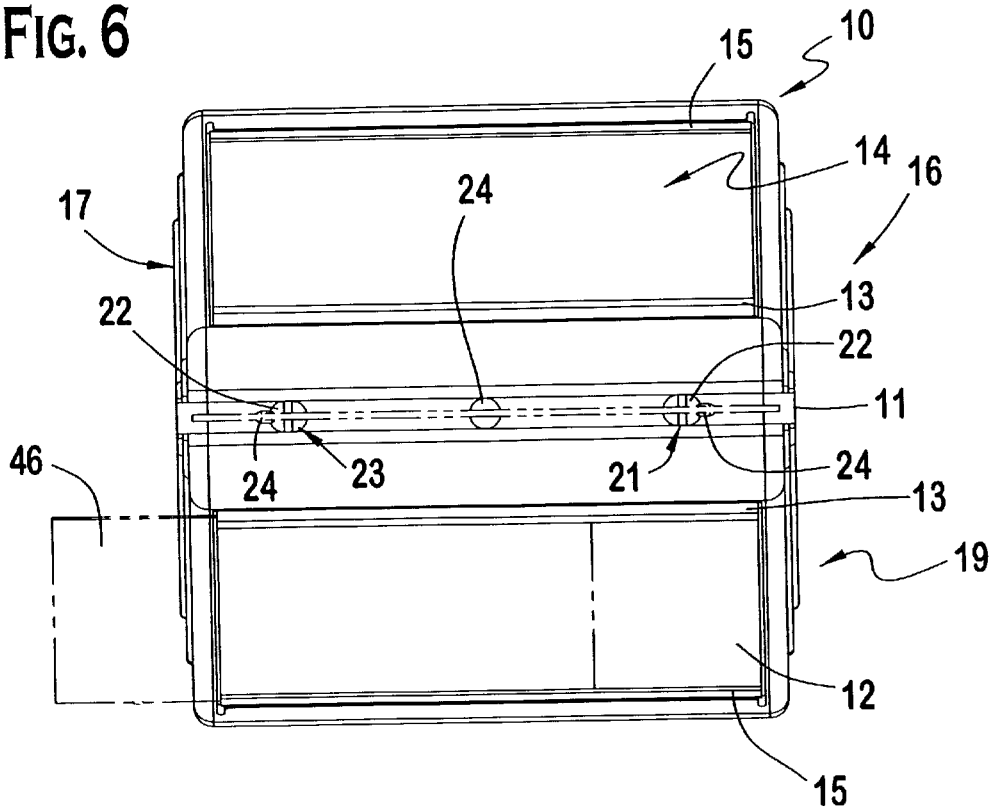
FIG. 6 is a top plan view of the sign base of FIG. 1.

Referring to FIGS. 2 and 6, the lower surface 18 preferably has a rectangular configuration with the longer sides extending between the two side surfaces 17 and 19. The lower surface 18 includes foot pads 8 at each corner. The rectangular configuration in conjunction with the foot pads 8 provide the base 10 a stable support surface. The contact points defined by the foot pads 8 also help prevent sliding of the unit. The center portion of the lower surface 18 is defined by a cavity 5, the function of which will be described in more detail hereinafter.

Figure 4:
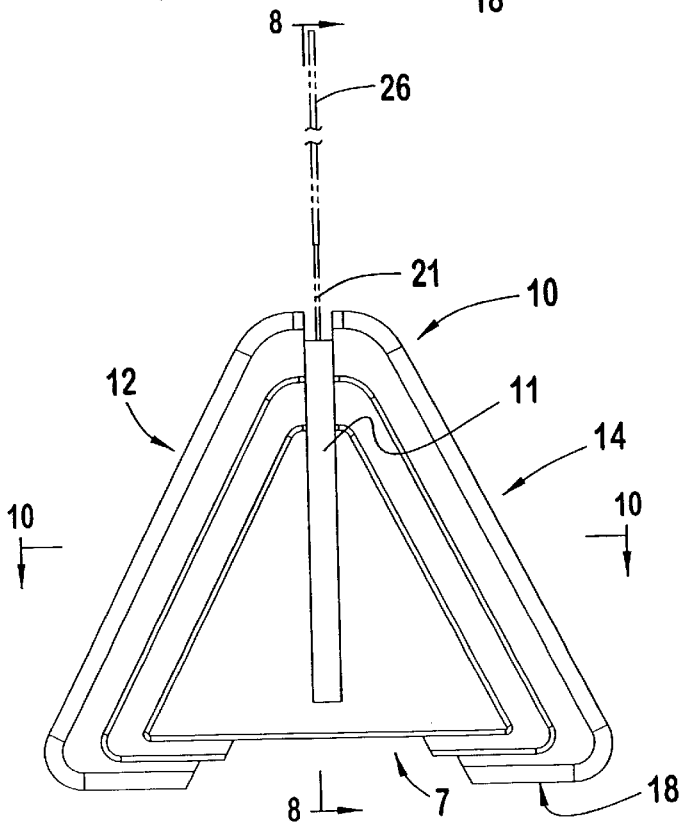
FIG. 4 is a side elevation of the sign base of FIG. 1.
Figure 5:
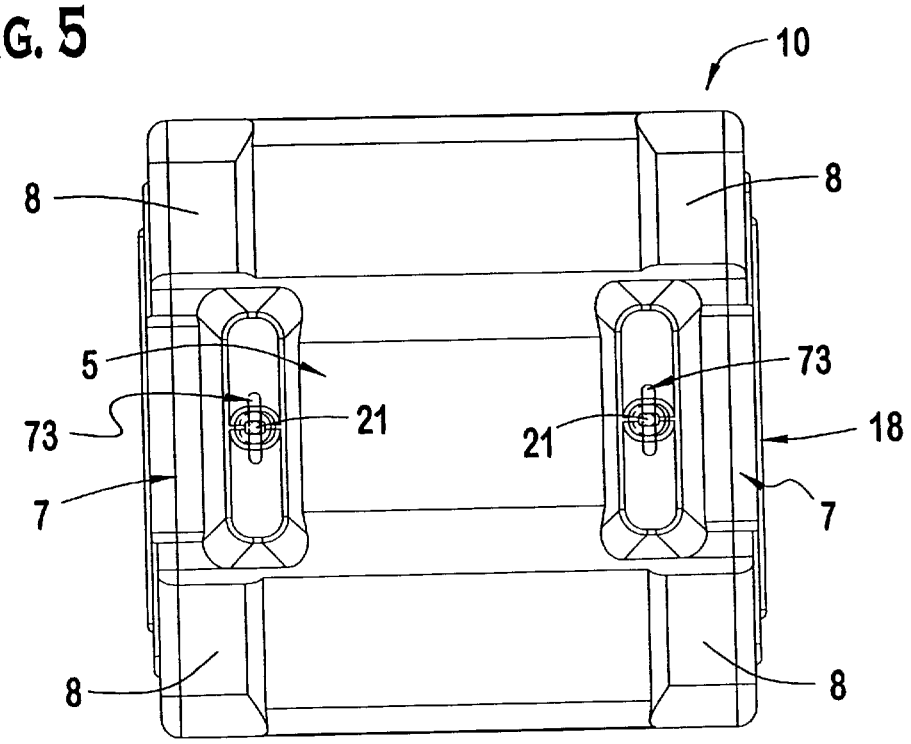
FIG. 5 is a bottom elevation plan view of the sign base of FIG. 1.

Referring to FIGS. 2 and 4, each side surface 17, 19 has a generally trapezoidal configuration with its longer edge extending along a respective shorter edge of the lower surface 18. Each side surface 17, 19 includes a lower notch 7 along its lower edge which extends into the cavity 5 thereby defining a lifting handle on each side of the sign base 10. The lower surface foot pads 8 further raise the notches 7, thereby making the handles more accessible.

Referring to FIGS. 1 and 6–8, the upper surface 16 extends between the shorter edges of the side surfaces 17, 19. The upper surface 16 includes a pair of sign rod receptacles 22. More or fewer sign rod receptacles 22 can be provided. Each receptacle 22 includes a recessed aperture 23 through which a portion of a sign rod 21 can be passed. A groove 24 extends from each recessed aperture 23. The grooves 24 are configured to receive a bend portion of the sign rod 21, thereby providing a stop and preventing the sign rod 21 from rotating. The sign rods 21 extend up from the bend portions above the upper surface 16 to receive a sign 75. The rods 21 are preferably configured to receive a plastic corrugated sign. The opposite end of each sign rod 21 is preferably threaded and extends through an aperture 27 in the lower surface aligned with the receptacle aperture 23. The cavity 5 allows a wing nut 73 or the like to be secured to the threaded portion of the rod 21 extending through aperture 27. The upper surface 16 also preferably includes an opening 34 which may be used to fill the internal chamber 35 of base 10 with weight material 37, for example water or sand.

Figure 7:
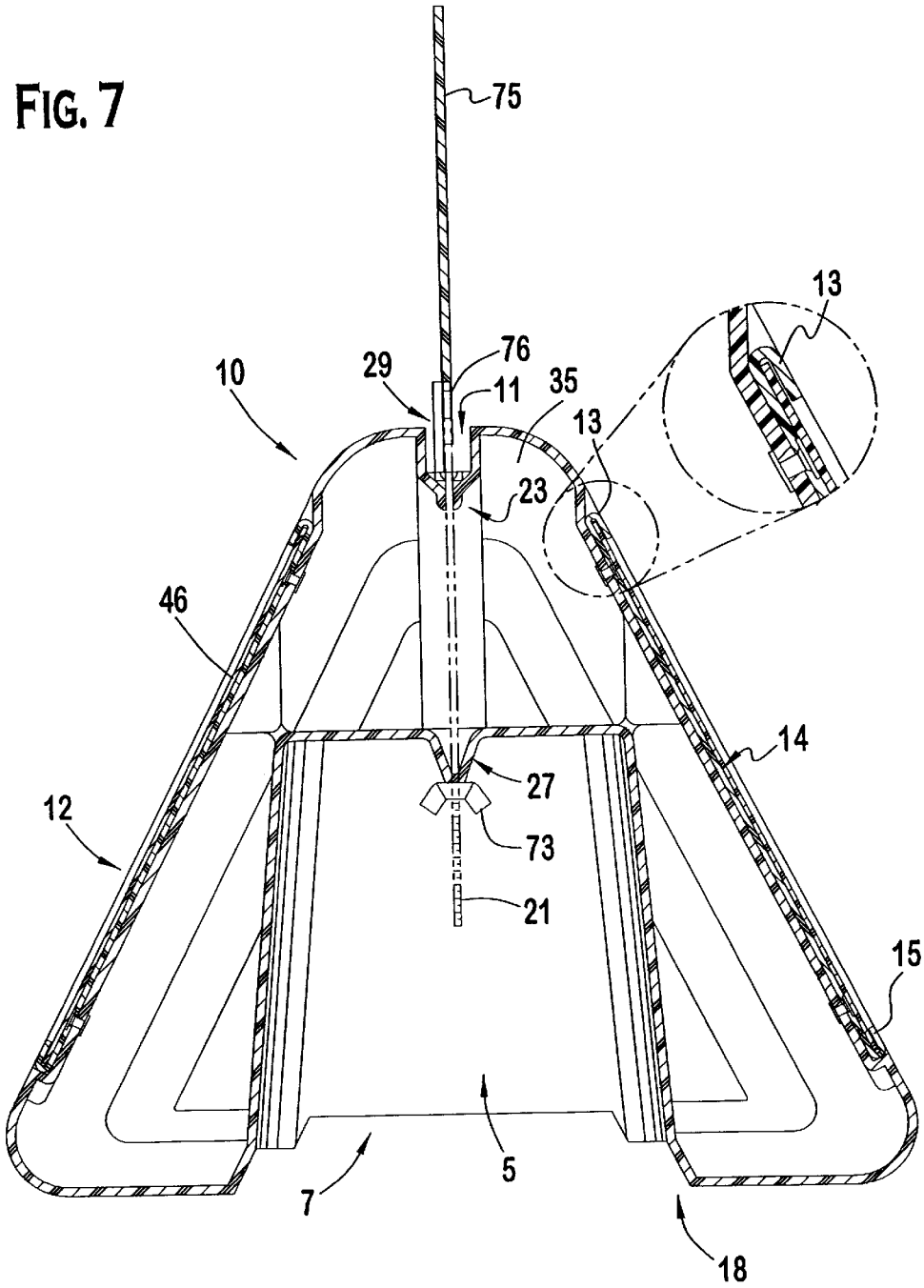
FIG. 7 is a sectional view taken along the line 7—7 in FIG. 3.
Figure 10:
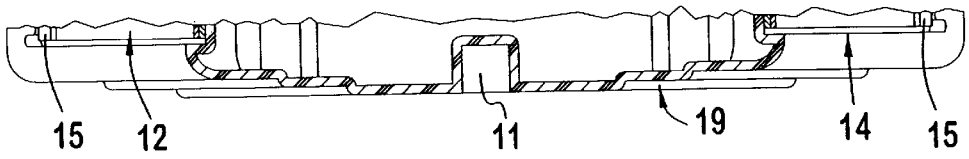
FIG. 10 is a sectional view taken along the line 10—10 in FIG. 4.
Figure 8:
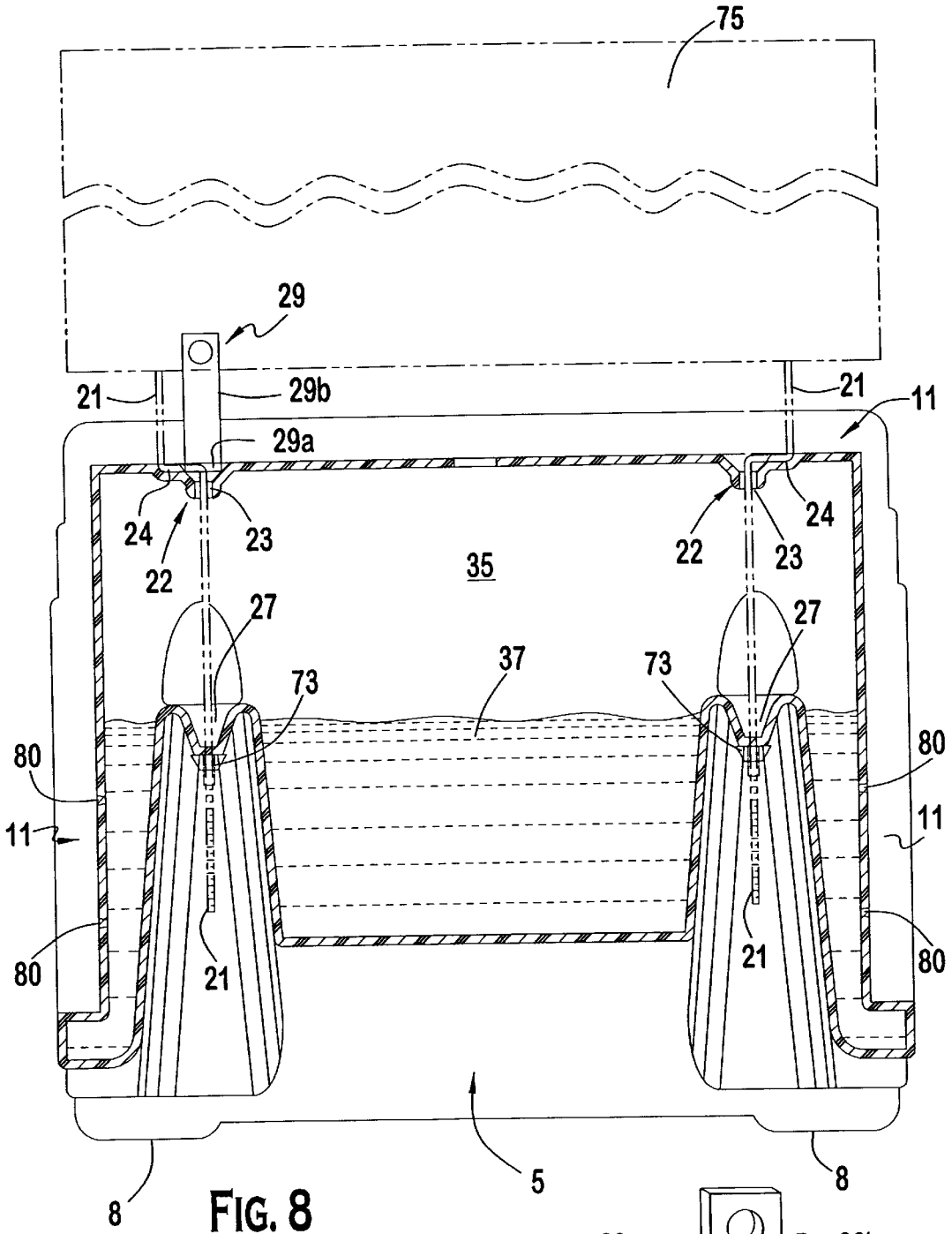
FIG. 8 is a sectional view taken along the line 8—8in FIG. 4
Figure 9:
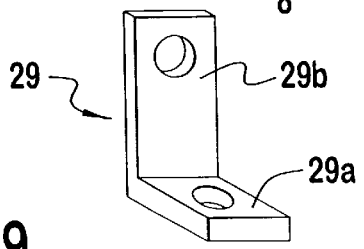
FIG. 9 is a perspective view of a sign lock component.

To prevent removal of the signage 75 from rods 21, a lock component 29 can be provided in conjunction with one or both of the rods 21. Referring to FIG. 9, an illustrative lock component 29 is shown. The lock component 29 includes a first apertured portion 29*a* through which the rod 21 can be passed and which seats adjacent the recessed aperture 23. Once the rod 21 is secured, the lock component 29 is maintained in position by the bend portion of the rod 21, as shown in FIG. 8. The lock component 29 includes a second apertured portion 29*b* which extends adjacent the signage 75. Referring to FIG. 7, the signage 75 can be provided with an aperture 76 which aligns with the aperture in the lock component 29. A lock, bolt or the like (not shown) can then be extended through the apertures and secured.

Referring to FIGS. 1 and 10–14, an external groove 11 extends along each side surface 17,19 and the upper surface 16. The groove 11 is configured to receive metal or plastic sign frame tubing. Tap holes 80 may be provided at various locations within the groove 11 for receiving tap screws 82 or the like for securing the frame tubing 25 to the base 10.

Illustrative frame tubing signage and support arrangements are shown in FIGS. 11–14. In the example shown in FIGS. 11 and 13, the support frame 25 includes two side support tubes 25*a* with upper and lower horizontal tubes 25*b,c* extending therebetween. The side tubes 25*a* and lower tube 25*c* include a continuous slot 26*a* and the upper tube 25*b* has a through slot 26*b*. Signage 75 is inserted through the through slot 26*b* and maintained in the continuous slot 26*a*. Other configurations of slotted frame tubing can be supported by the groove 11.

Figure 12:
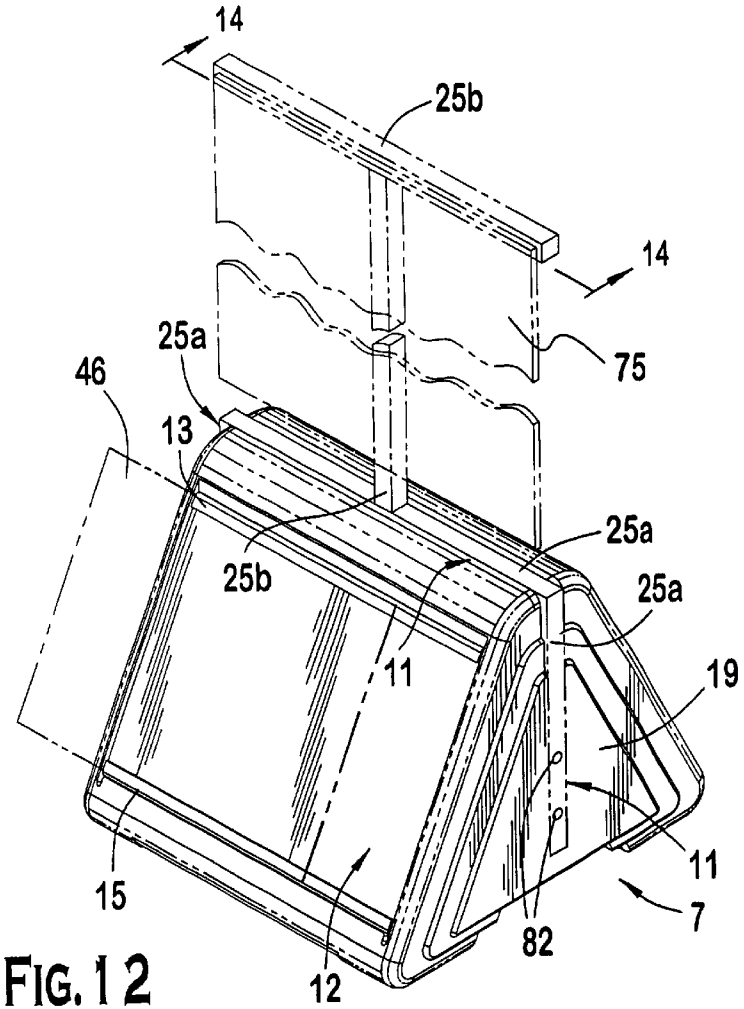
FIGS. 11 and 12 are perspective views of the sign base of FIG. 1 showing alternate sign support configuration
Figure 11:
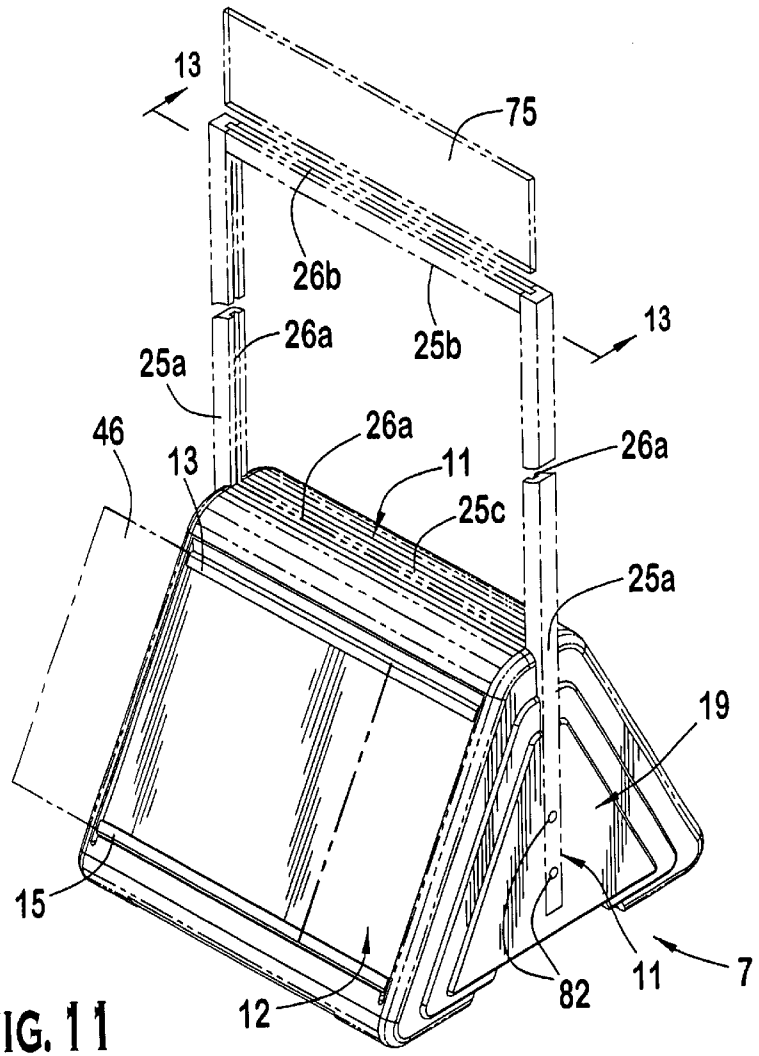
Figure 13:
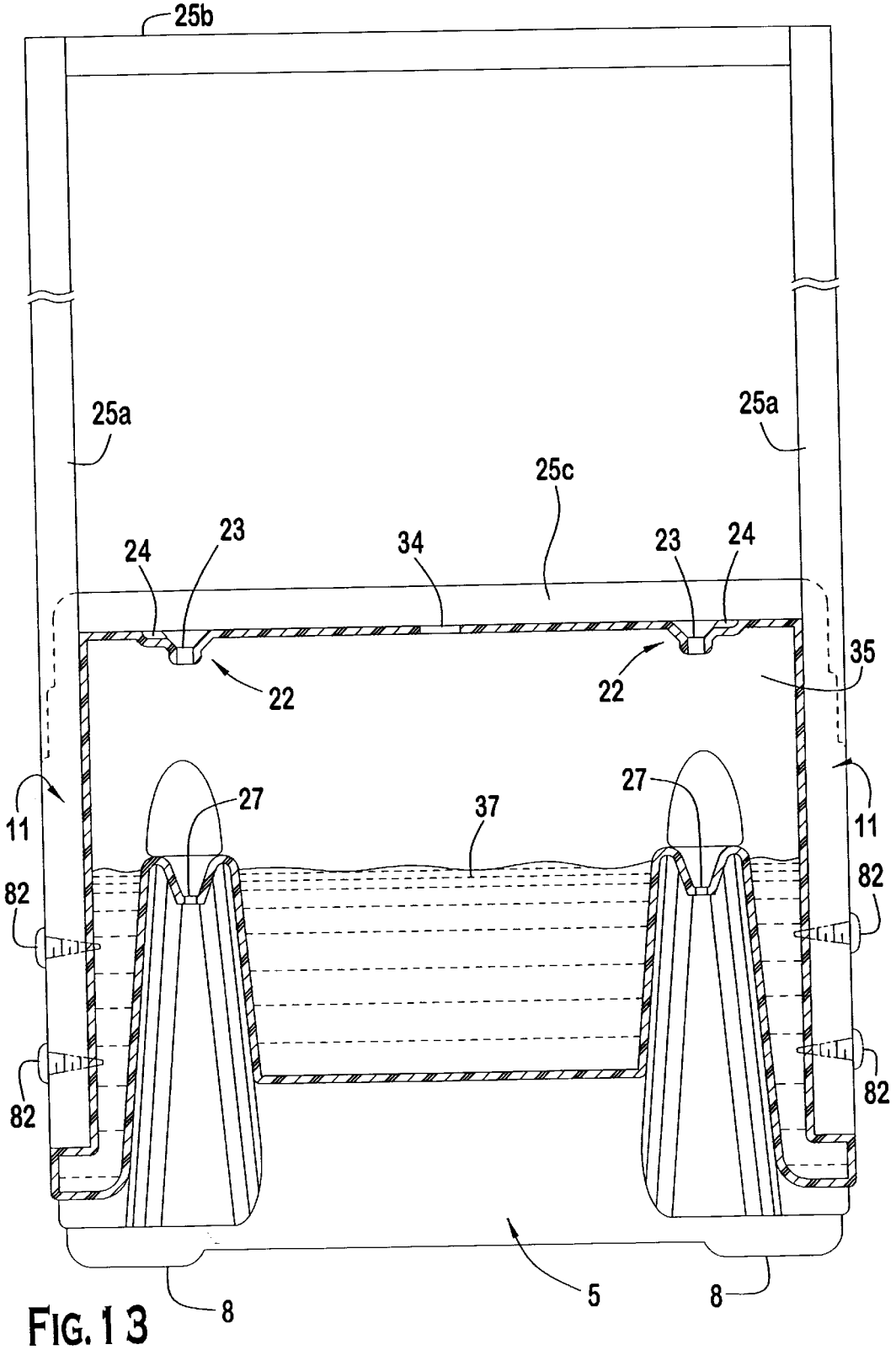
FIG. 13 is a sectional view taken along the line 13—13 in FIG. 11.
Figure 14:
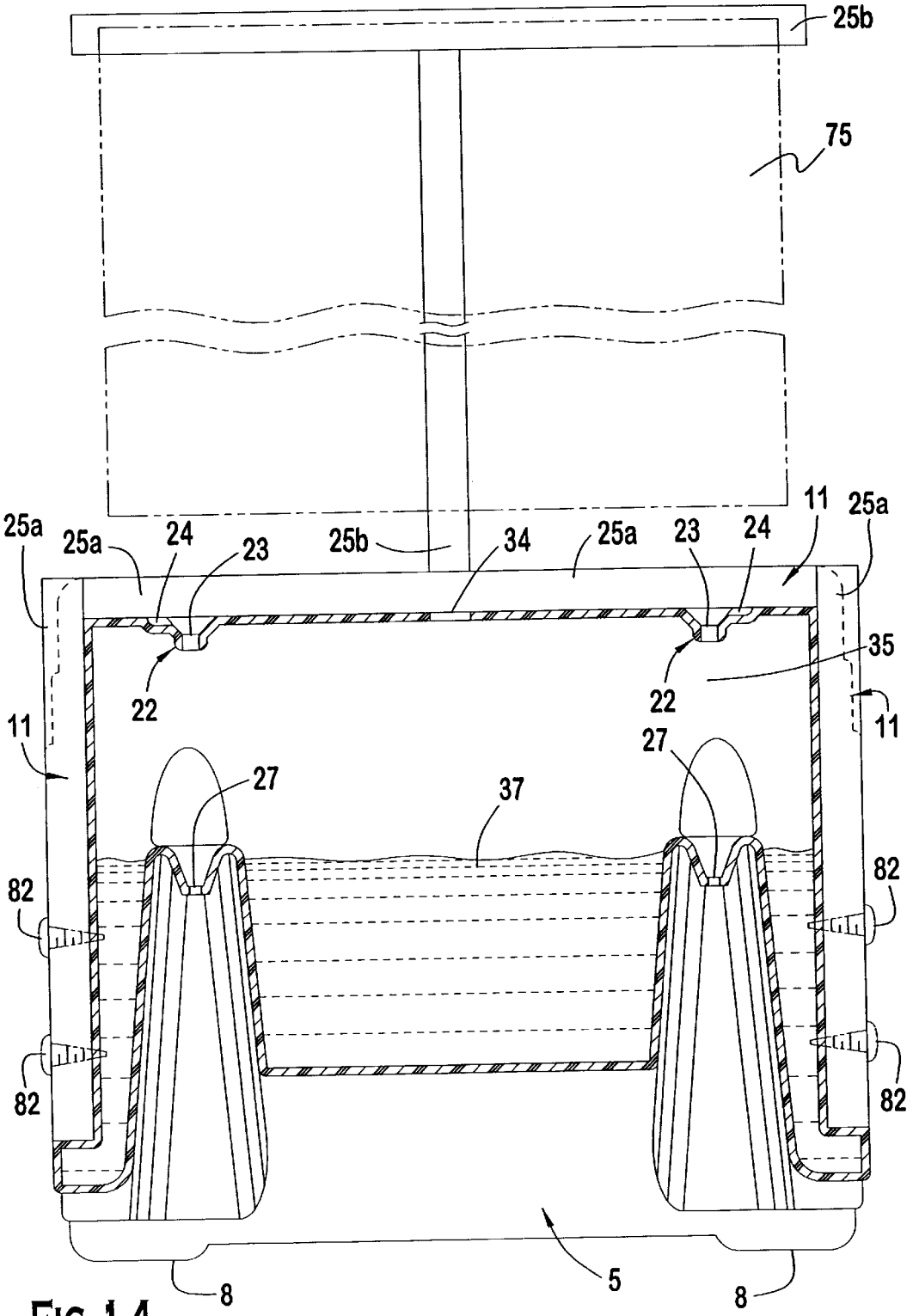
FIG. 14 is a sectional view taken along the line 14—14 in FIG. 12.

In the example shown in FIGS. 12 and 14, a tube base 25*a* is secured in the groove 11 with a support rod 26*b* extending up therefrom. Various signage 75, including banners, can be secured to the support rod 26*b* in various known manners.

Referring to FIGS. 1–3 and 7, the front an d rear surfaces 12, 14 extend from the longer edge of the lower surface 18 inward to the narrower upper surface 16. The front and rear surfaces 12,14 each preferably include an upper channel 13 and a lower channel 15 adapted to receive changeable signage 46 therein. The signage 46 is slidably mounted within the channels 13, 15 which serve to hold the edges of the signage 46 in position. If it is desired to change the signage6 46, such can be removed and a new indicia inserted in its place. The channels 13, 15 preferably extend across the width of the surface, but may be segmented to provide support at spaced locations. The channels 13,15 can be formed integral with the surfaces 12,14 or can be formed separately and secured thereto.

Figure 15:
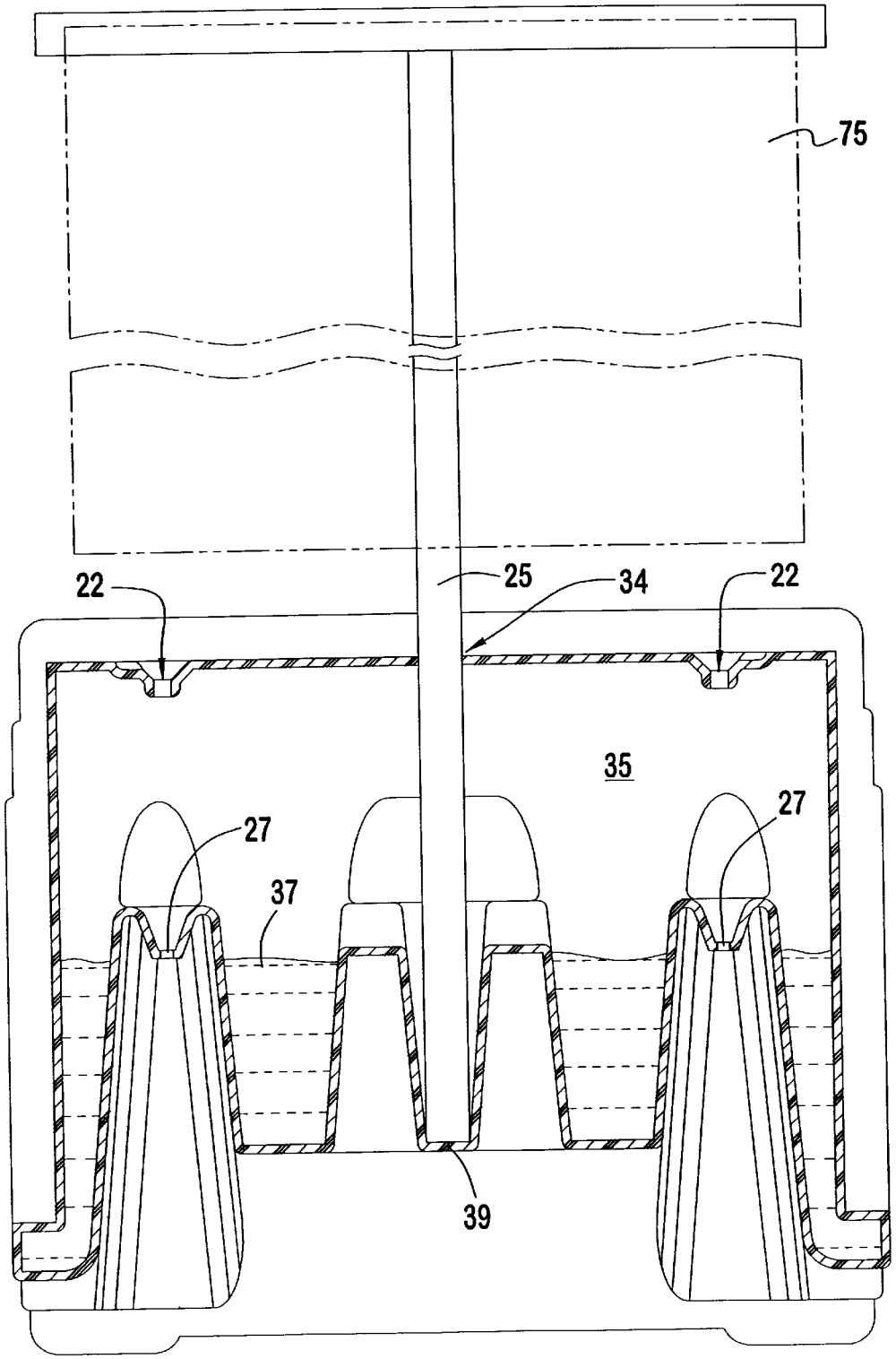
FIG. 15 is a sectional view showing an alternate sign support configuration.
Figure 16:
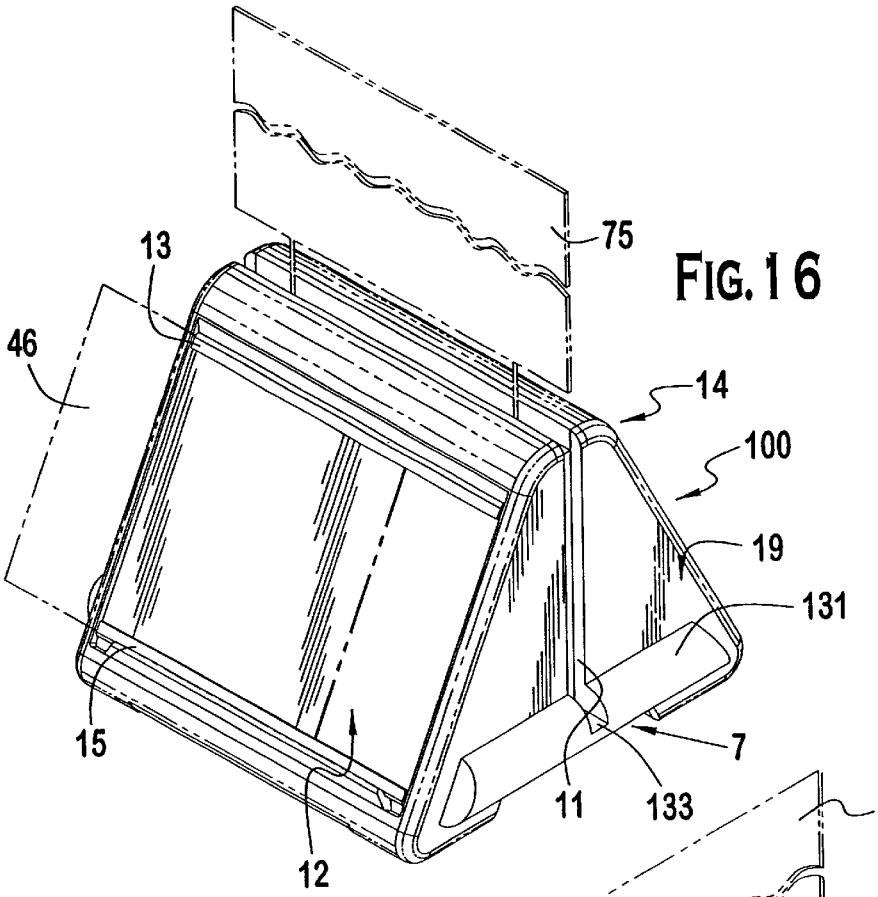
FIG. 16 is a top perspective view of an alternative embodiment of the present invention.
Figure 17:
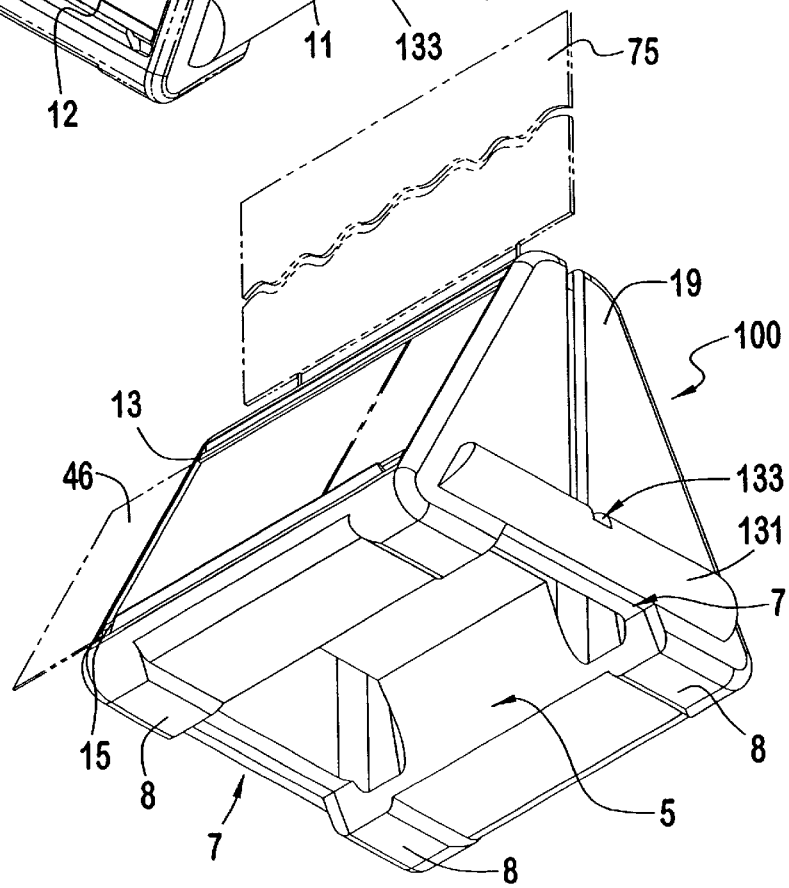
FIG. 17 is a bottom perspective view of the sign base of FIG. 16.
Figure 18:
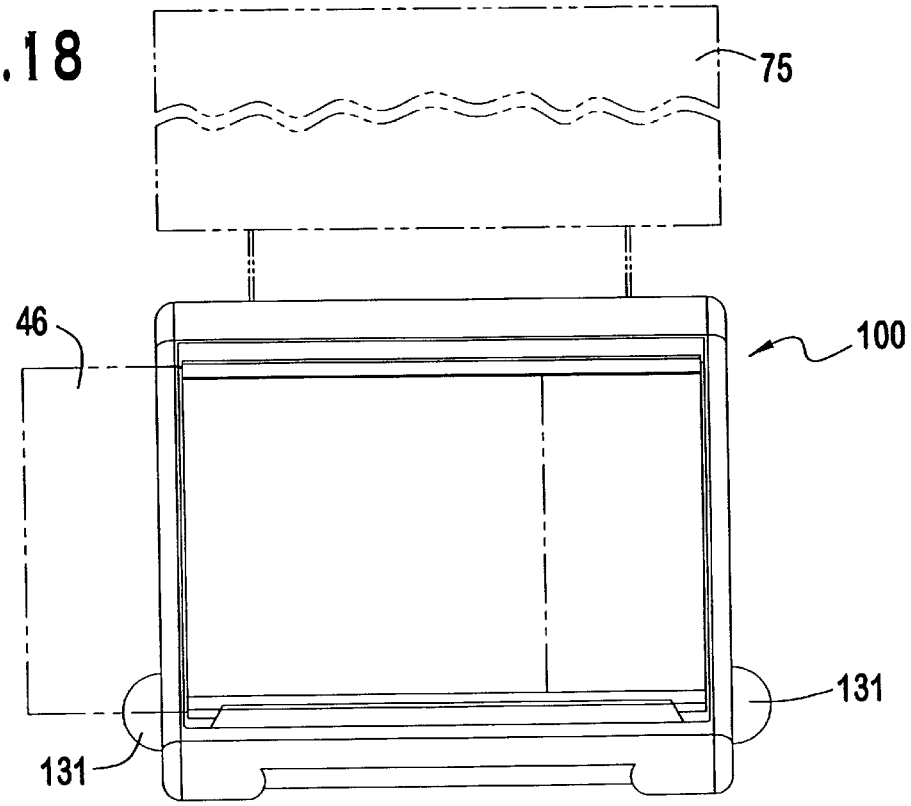
FIG. 18 is a front elevation of the sign base of FIG. 16.
Figure 19:
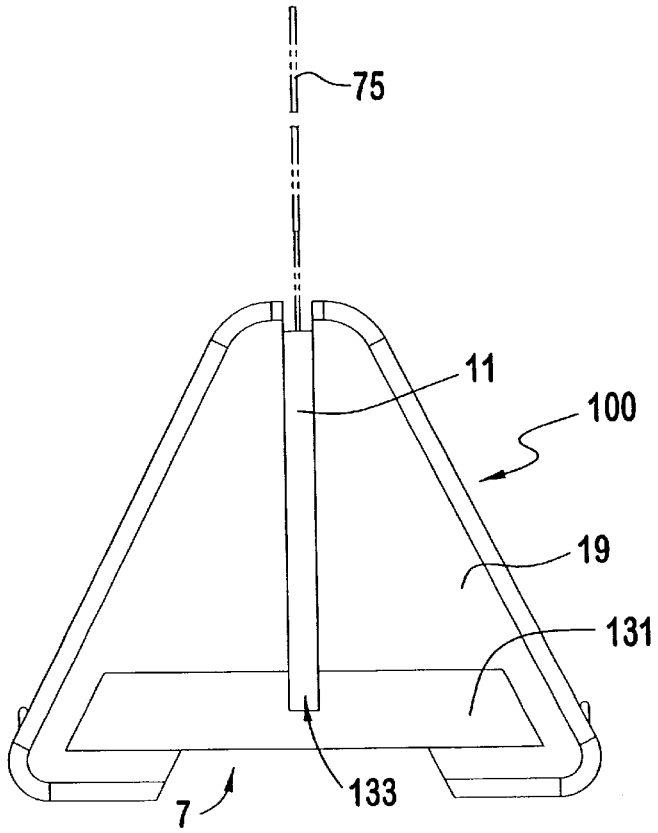
FIG. 19 is a side elevation of the sign base of FIG. 16.
Figure 20:
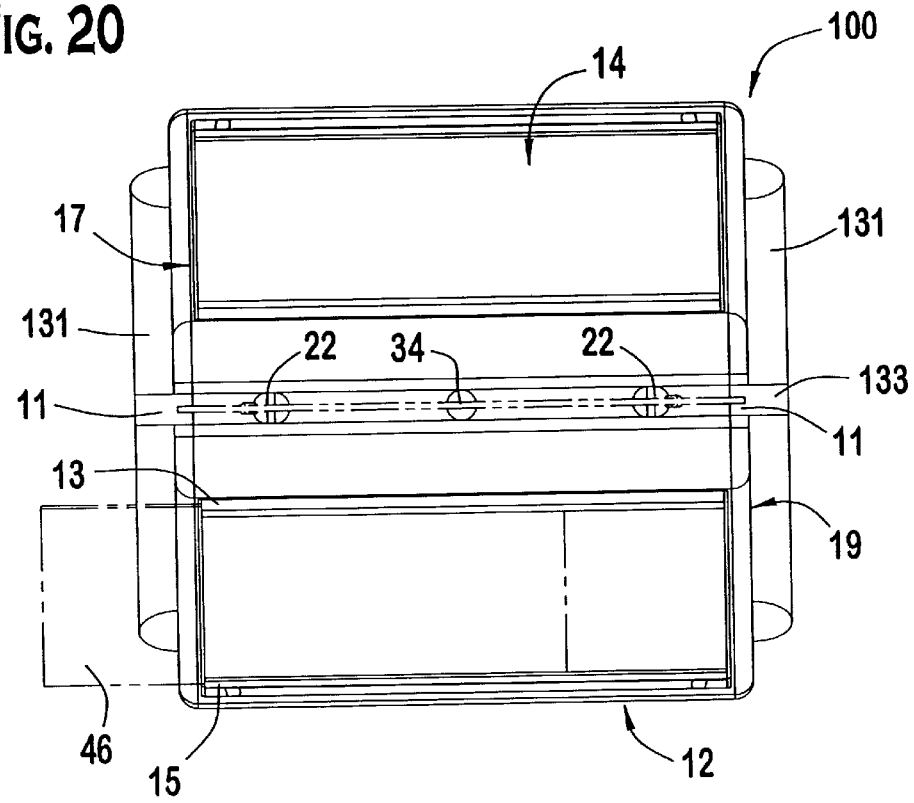
FIG. 20 is a top plan view of the sign base of FIG. 16.
Figure 21:
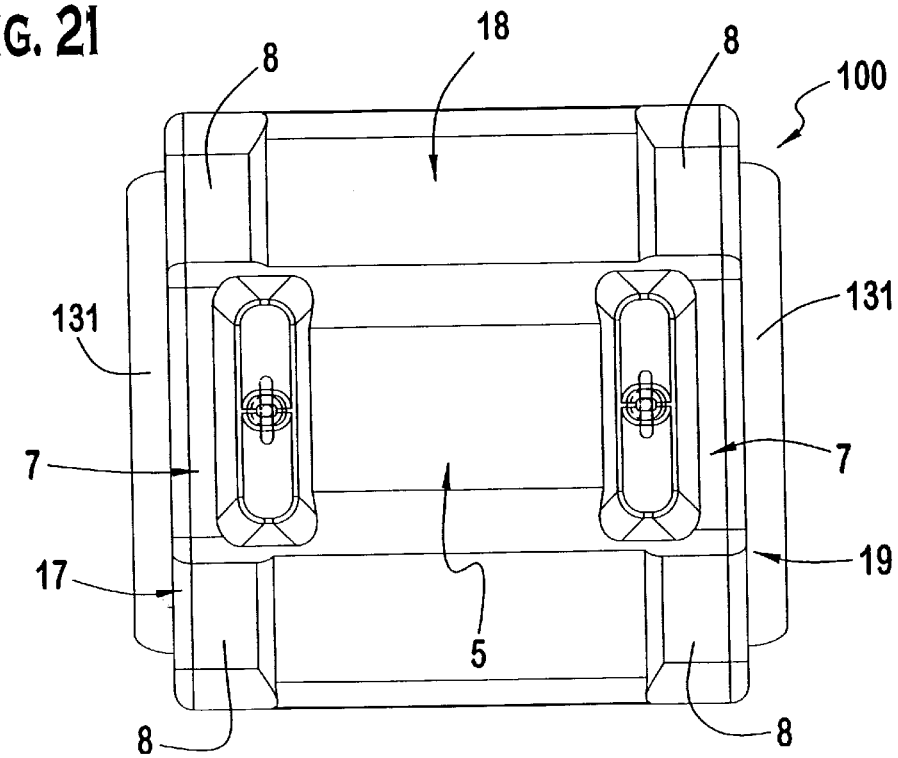
FIG. 21 is a bottom plan view of the sigh base of FIG. 16.
Figure 22:
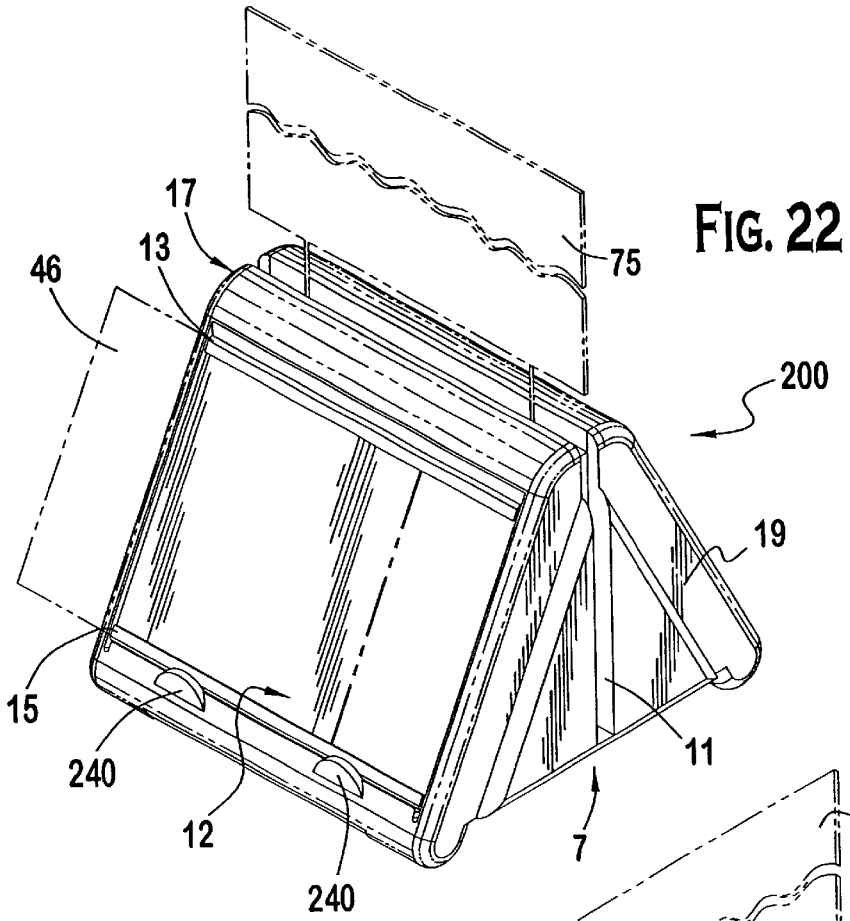
FIG. 22 is a top perspective view of another alternative embodiment of the present invention.
Figure 23:
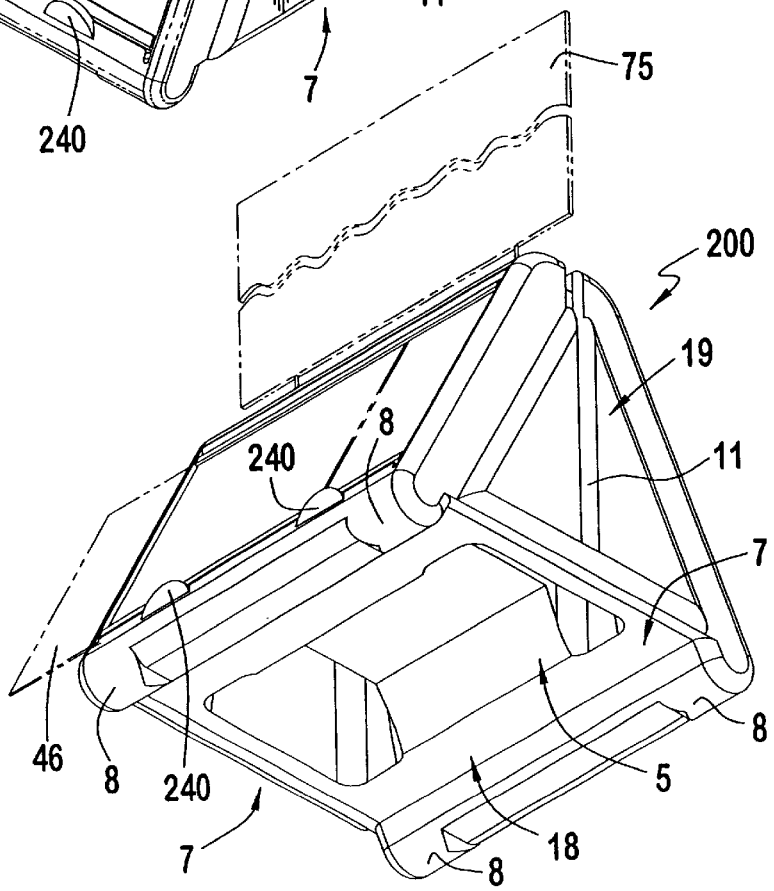
FIG. 23 is a bottom perspective view of the sign base of FIG. 22.
Figure 24:
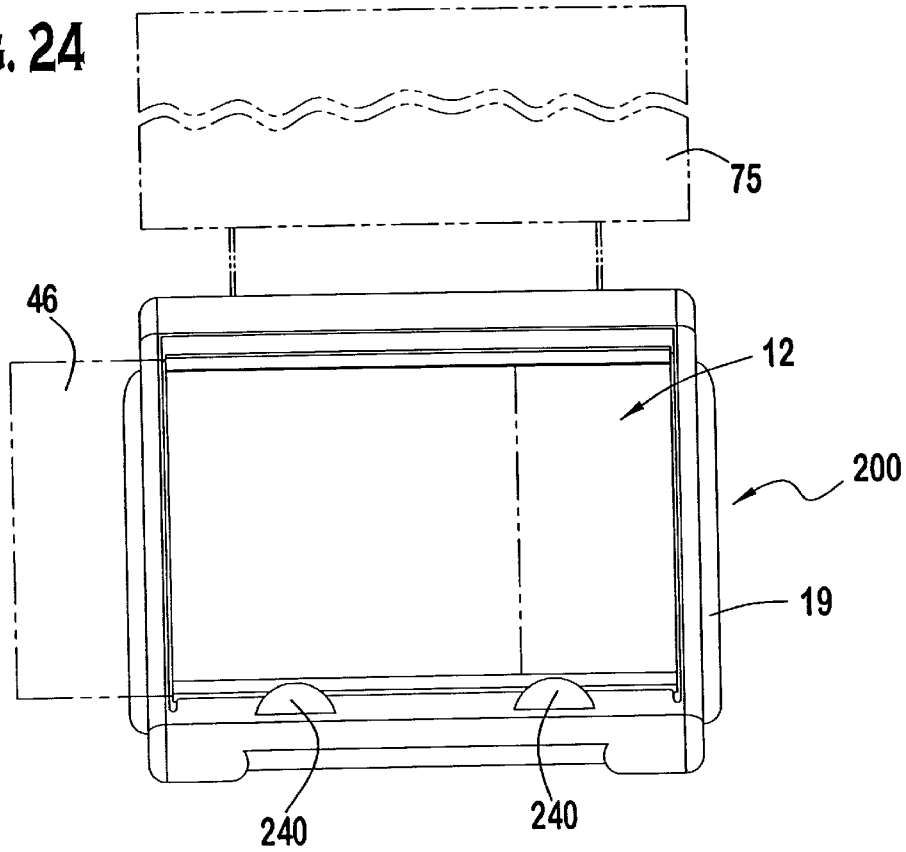
FIG. 24 is a front elevation of the sign base of FIG. 22.
Figure 25:
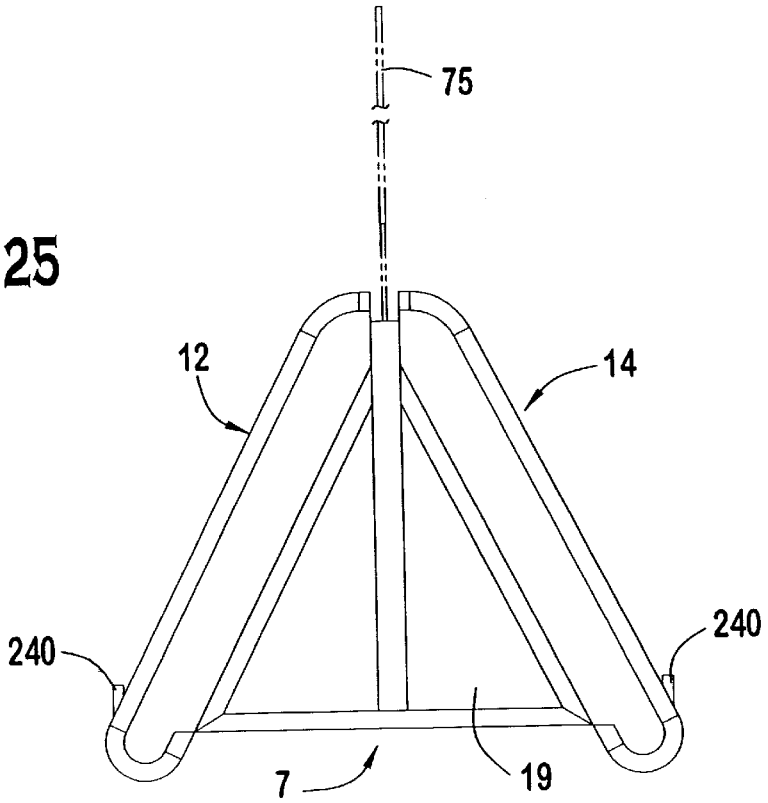
FIG. 25 is a front elevation of the sign base of FIG. 22.
Figure 26:
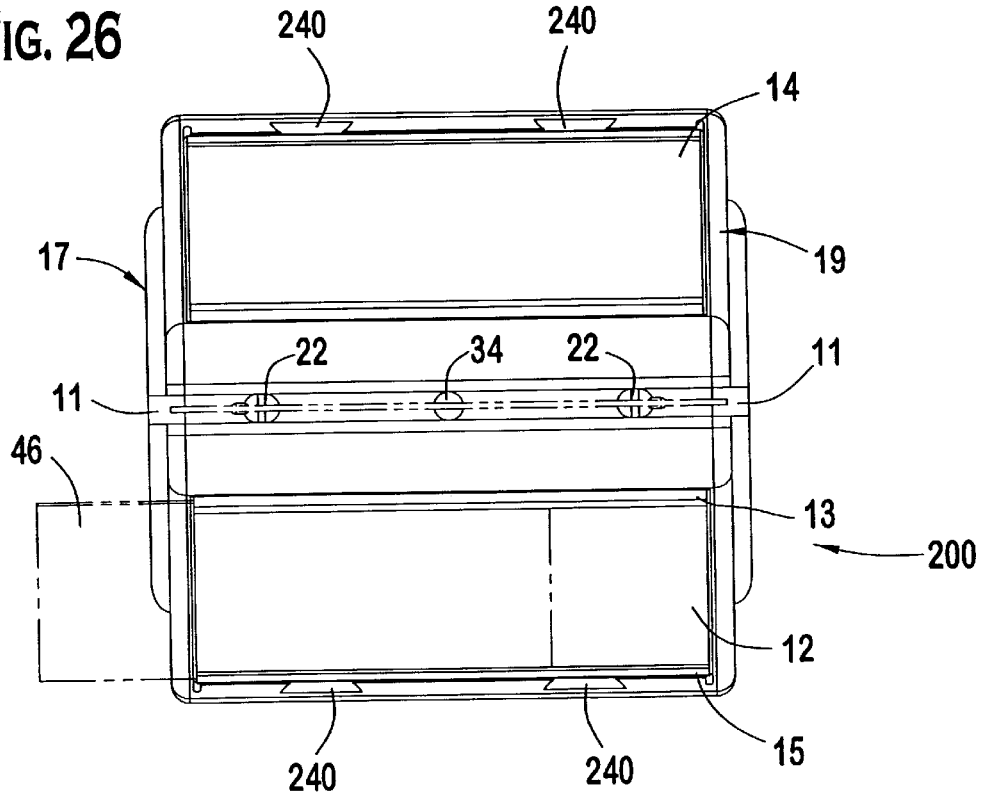
FIG. 26 is a top plan view of the sign base of FIG. 22.
Figure 27:
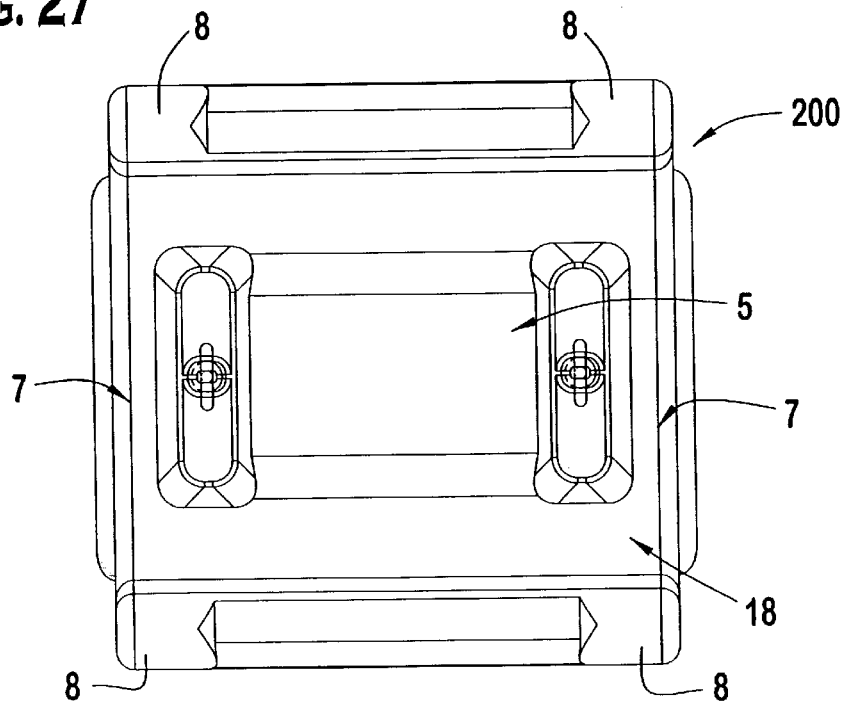
FIG. 27 is a bottom plan view of the sign base of FIG. 22.

FIG. 15 shows an alternate sign support configuration. In this embodiment, fill opening 34 is also configured to receive a frame tubing support 25 from which signage 75 can be supported. The opening 34 preferably has a square configuration to prevent rotation of the frame tubing support 25. The internal chamber 35 is provided with a seat 39 which receives and supports the frame tubing support 25.

FIGS. 16–21 illustrate an alternate embodiment 100 of the present invention. Sign base 100 has a structure similar to that of sign base 10, with the addition of an external protrusion 131 extending from each side surface 17, 19 adjacent the notch 7. The protrusion defines a more substantial handle. Additionally, the protrusion 131 includes a groove 133 aligned with the side surface groove 11. The bottom surface of the protrusion groove 133 provides a larger platform to support the support tubing 25.

FIGS. 22–27 illustrate another alternate: embodiment 200 of the present invention. Sign base 200 has a structure similar to that of sign base 10, with the addition of clips 240 positioned adjacent the lower channel 15 on the front 12 and rear 14 surfaces. The clips 240 provide supports for a protective overlay (not shown) if such is used. Alternatively, the channels 13, 15 can be configured such that a protective overlay can be inserted therein in addition to the advertising indicia 46.

What is claimed is:

1. A base for supporting variable signage comprising:

a support surface with front and back planar surfaces extending therefrom, the front and back planar surfaces spaced apart by opposed side surfaces extending therebetween, each planar surface including at least two opposed channels adapted to receive and support a changeable signage against the planar surface; and at least one signage support receptacle formed integral with the base wherein the signage support receptacle includes a vertical groove in one of the side surfaces.

2. The base of claim 1, wherein the signage support receptacle includes a vertical groove in the opposite side surface.

3. The base of claim wherein the signage support receptacle is further defined by a groove extending between the two side surface grooves.

4. A base for supporting variable signage comprising:

a support surface with front and back planar surfaces extending therefrom, the front and back planar surfaces spaced apart by opposed side surfaces extending therebetween, each planar surface including at least two opposed channels adapted to slidably receive and support a changeable signage in contacting engagement with the planar surface; and at least one signage support receptacle formed integral with the base; and an upper surface opposite the support surface and extending between the side surfaces and planar surfaces.

5. The base of claim 4, wherein a portion of the upper surface defines an aperture therethrough as the signage support receptacle.

6. The base of claim 4 wherein the support surface, planar surfaces, side surfaces, and upper surface define a hollow housing.

7. The base of claim 6 including an opening to permit filling of the hollow housing.

8. A base for supporting variable signage comprising:

a support surface with front and back planar surfaces extending therefrom, the front and back planar surfaces spaced apart by opposed side surfaces extending therebetween, each planar surface including at least two opposed channels adapted to receive and support a changeable signage against the planar surface;

at least one signage support receptacle formed integral with the base;

an upper surface opposite the support surface and extending between the side surfaces and planar surfaces, wherein a portion of the upper surface defines an aperture therethrough as the signage support receptacle; and a depression adjacent the aperture and adapted to receive a bend portion of a signage post and support and prevent rotation thereof.

9. The base of claim 8 wherein the aperture is positioned in a recess which is sized to receive a lock component, the lock component including two portions, each having an aperture therethrough, such that one of the lock component apertures aligns with the signage support receptacle aperture to receive the signage post.

10. A base for supporting variable signage comprising:

a support surface with front and back planar surfaces extending therefrom, the front and back planar surfaces spaced apart by opposed side surfaces extending therebetween, each planar surface including at least two opposed channels adapted to slidably receive and support a changeable signage in contacting engagement with the planar surface, wherein each side surface presents a trapezoidal profile defined by two non-parallel edges and two generally parallel edges, one of the parallel edges being longer than the other;

at least one signage support receptacle formed integral with the base; and wherein the channels are within the trapezoidal profiles of the opposed side surfaces.

11. A base for supporting variable signage comprising:

a support surface with front and back planar surfaces extending therefrom, the front and back planar surfaces spaced apart by opposed side surfaces extending therebetween, each planar surface including at least two opposed channels adapted to slideably receive and support a changeable signage in contact engagement with the planar surface, wherein the channels are configured to receive a protection overlay positioned adjacent the changeable signage; and at least one signage support receptacle formed integral with the base.

12. A base for supporting variable signage comprising:

a support surface, opposed first and second planar surfaces extending from the support surface, opposed, generally trapezoidal, first and second side surfaces extending from the support surface between the opposed planar surfaces, and an upper surface opposite the support surface and extending between the opposed planar surfaces and opposed side surfaces, each planar surface including at least two opposed channels adapted to receive and support a changeable signage against the planar surface;

the support surface having a generally rectangular configuration defining two long edges, two short edges and four comers, each planar surface extending from a respective support surface long edge and each side surface extending from a respective lower surface short edge;

the upper surface having a generally rectangular configuration defining two long edges equal in length to the support surface long edges and two short edges shorter than the support surface short edges whereby a generally trapezoidal housing is defined;

at least one signage support receptacle formed integral with the housing; and a securing device adapted to engage the variable signage to secure at least a portion of the variable signage within the base.

13. The base of claim 12 wherein the support surface includes a foot pad proximate each corner.

14. The base of claim 12 herein each side surface includes a notch defining a lifting handle.

15. The base of claim 14 wherein the support surface includes a cavity extending toward the upper surface, the cavity communicating with the notches to further define each lifting handle.

16. A base for supporting variable signage comprising:

a support surface with front and back planar surfaces extending therefrom, the front and back planar surfaces spaced apart by opposed side surfaces extending therebetween, each planar surface including at least two opposed channels adapted to slidably receive and support a changeable signage against the planar surface;

at least one signage support receptacle formed integral with the base; and a securing device adapted to engage the variable signage to secure at least a portion of the variable siganage within the base.

* * * * *

UNITED STATES PATENT AND TRADEMARK OFFICE

CERTIFICATE OF CORRECTION

PATENT NO. : 6,412,743 B1
DATED : July 2, 2002
INVENTOR(S) : Michael J. Fell

It is certified that error appears in the above-identified patent and that said Letters Patent is hereby corrected as shown below:

Column 1,
Line 56, after the word “bottom”, please delete the word “elevation”

Column 2,
Line 24, after the word “a”, pleaser delete “front”, and insert therefor -- side --.

Column 3,
Line 47, after the word “front” please delete “an d”, and insert therefor -- and --.

Column 4,
Line 10, after the word “alternate”, please delete “:”.
Line 34, after the word “claim” please insert -- 2 --.

Column 6,
Line 8, after the word “four”, delete “comers” and insert therefor -- corners --.

Signed and Sealed this

Twenty-eighth Day of January, 2003

JAMES E. ROGAN
*Director of the United States Patent and Trademark Office*